US010690411B2

(12) United States Patent
Tamura

(10) Patent No.: US 10,690,411 B2
(45) Date of Patent: Jun. 23, 2020

(54) PAINT DRYING OVEN

(71) Applicant: TRINITY INDUSTRIAL CORPORATION, Toyota-shi, Aichi (JP)

(72) Inventor: Satoshi Tamura, Toyoake (JP)

(73) Assignee: TRINITY INDUSTRIAL CORPORATION, Toyota-shi (JP)

( * ) Notice: Subject to any disclaimer, the term of this patent is extended or adjusted under 35 U.S.C. 154(b) by 0 days.

(21) Appl. No.: 16/086,446

(22) PCT Filed: Nov. 15, 2016

(86) PCT No.: PCT/JP2016/083766
§ 371 (c)(1),
(2) Date: Sep. 19, 2018

(87) PCT Pub. No.: WO2017/179234
PCT Pub. Date: Oct. 19, 2017

(65) Prior Publication Data

US 2019/0101331 A1 Apr. 4, 2019

(30) Foreign Application Priority Data

Apr. 13, 2016 (JP) ..... 2016-080030

(51) Int. Cl.
*F26B 21/04* (2006.01)
*F26B 23/02* (2006.01)
(Continued)

(52) U.S. Cl.
CPC ..... *F26B 21/04* (2013.01); *B05C 9/14* (2013.01); *F26B 15/12* (2013.01); *F26B 23/02* (2013.01); *F26B 2210/12* (2013.01)

(58) Field of Classification Search
None
See application file for complete search history.

(56) References Cited

U.S. PATENT DOCUMENTS 3,604,824 A * 9/1971 Hardison ..... F23G 7/066 431/116
4,098,567 A * 7/1978 Hubbert ..... F23C 13/00 431/115
4,441,880 A * 4/1984 Pownall ..... F23G 7/065 110/203

FOREIGN PATENT DOCUMENTS

JP S62-106680 U 7/1987
JP S62-136735 U 8/1987
(Continued)

OTHER PUBLICATIONS

Jan. 1, 2017 Written Opinion issued in International Patent Application No. PCT/JP2016/083766.
(Continued)

*Primary Examiner* — Charles Capozzi
(74) *Attorney, Agent, or Firm* — Oliff PLC

(57) ABSTRACT

A circulation channel circularly supplying air heated by a burner is connected to a drying chamber into which a painted workpiece is supplied. The circulation channel includes a flame holding cylinder surrounding a flame of the burner and a casing surrounding the flame holding cylinder from outside and protrudes further than the flame holding cylinder toward a front end side, opposite to a side of the burner, of the flame holding cylinder. The casing includes a low temperature air inlet port that introduces low temperature air from outside into the casing, an exhaust port that exhausts high temperature air heated by the burner and the low temperature air to the circulation channel, and a mixing mechanism that is formed in the casing and mixes the high temperature air and the low temperature air before the high temperature air and the low temperature air are exhausted from the exhaust port.

6 Claims, 14 Drawing Sheets

(51) Int. Cl.
*F26B 15/12* (2006.01)
*B05C 9/14* (2006.01)

(56) References Cited

FOREIGN PATENT DOCUMENTS

| | | | |
|---|---|---|---|
| JP | H01-144605 | U | 10/1989 |
| JP | H06-331274 | A | 11/1994 |
| JP | H07-113579 | A | 5/1995 |
| JP | H11-276967 | A | 10/1999 |
| JP | 2005-083689 | A | 3/2005 |
| JP | 2007-163117 | A | 6/2007 |

OTHER PUBLICATIONS

Jan. 17, 2017 International Search Report issued in International Patent Application No. PCT/JP2016/083766.
Nov. 6, 2019 Office Action issued in Chinese Patent Application No. 201680081381.8.
Apr. 7, 2020 Office Action issued in Japanese Patent Application No. 2016-080030.

* cited by examiner

PAINT DRYING OVEN

TECHNICAL FIELD

The present invention relates to a paint drying oven that dries a painted workpiece.

BACKGROUND ART

Conventionally, as this type of a paint drying oven, a drying oven is known in which air heated by a burner is circularly supplied into a drying chamber into which a workpiece is to be supplied (for example, see Patent Literature 1). Further, in recent years, there has been proposed a configuration that includes a flame holding cylinder surrounding a flame of a burner and a burning cylinder covering the flame holding cylinder from outside, where low temperature air is supplied into the burning cylinder from outside.

CITATIONS LIST

Patent Literature

Patent Literature 1: Japanese Unexamined Patent Application Publication No. 2005-83689 (paragraph [0029], FIG. 1)

SUMMARY OF INVENTION

Technical Problems

A configuration in which low temperature air is introduced into a burning cylinder has a problem that yellowing of a paint film can be caused due to a large variation in the temperature of the air to be supplied into a drying chamber, thereby producing a defective product.

The present invention has been made in view of the above circumstance, and an object of the present invention is to provide a paint drying oven that can reduce production of defective products.

Solutions to Problems

A paint drying oven according to one aspect of the present invention made to achieve the above object includes a drying chamber into which a painted workpiece is to be supplied, a circulation channel connected to the drying chamber to circularly supply air heated by a burner, a flame holding cylinder that is provided in the circulation channel and surrounds a flame of the burner, a casing that is provided in the circulation channel, surrounds the flame holding cylinder from outside, and projects further than the flame holding cylinder toward a front end side, opposite to a burner side, of the flame holding cylinder, a low temperature air inlet port provided on the casing to introduce low temperature air from outside into the casing, an exhaust port provided on a front end part of the casing to exhaust high temperature air heated by the burner and the low temperature air to the circulation channel, and a mixing mechanism that is provided in the casing and mixes the high temperature air and the low temperature air before the high temperature air and the low temperature air are exhausted from the exhaust port.

DESCRIPTION OF EMBODIMENTS

First Embodiment

Figure 1:
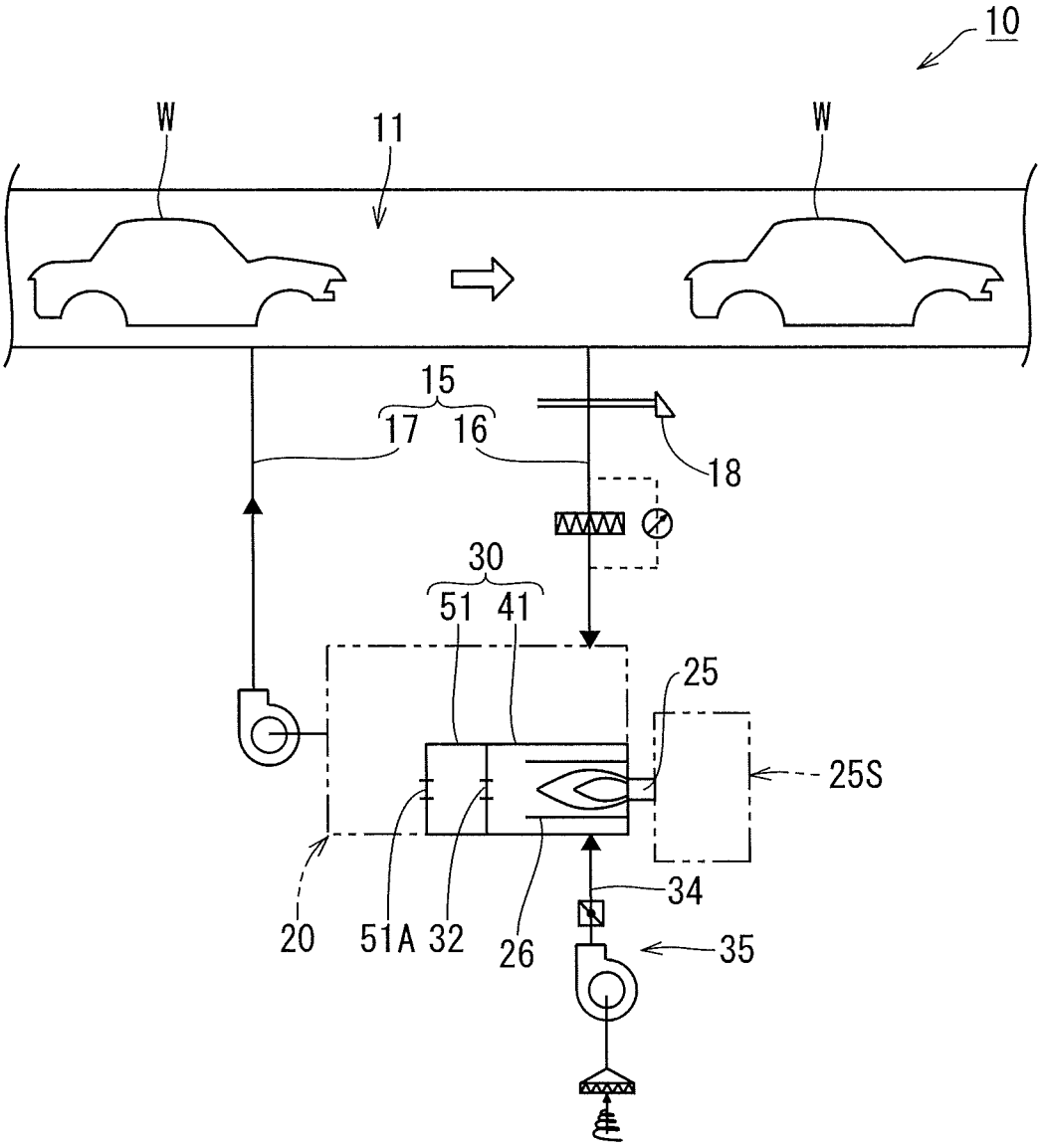
FIG. 1 is a diagram conceptually showing a paint drying oven according to a first embodiment of the present invention.
Figure 2:
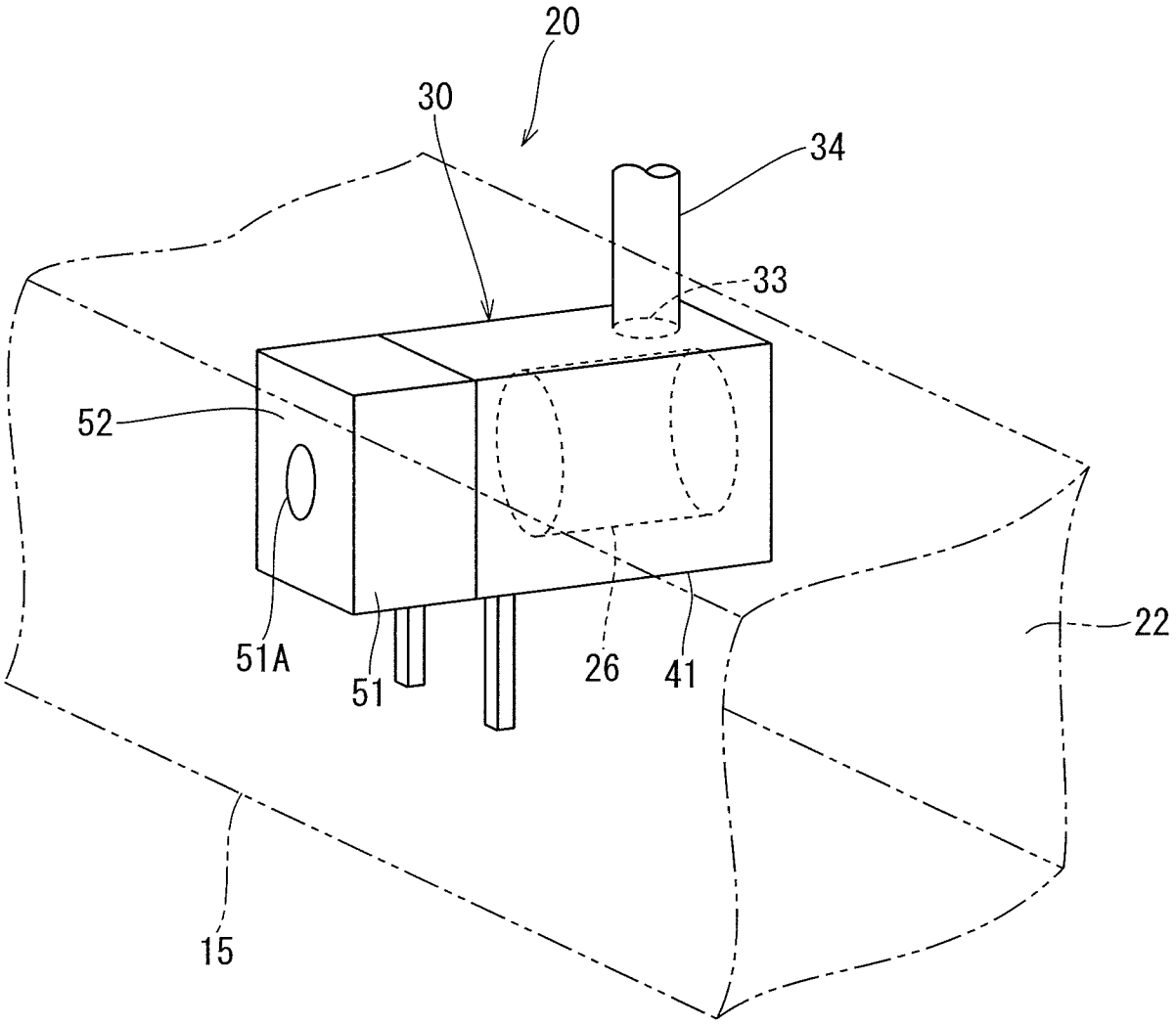
FIG. 2 is a diagram conceptually showing part of a circulation channel, in which part a casing and a flame holding cylinder are provided.

Hereinafter, a first embodiment of the present invention will be described with reference to FIGS. 1 to 3B. As shown in FIG. 1, a paint drying oven 10 of the present embodiment includes a drying chamber 11 into which painted workpieces W (for example, vehicle bodies) are to be successively supplied and a circulation channel 15 connected to the drying chamber 11. The circulation channel 15 is configured with, for example, a duct. In a middle of the circulation channel 15, there is provided a burning mechanism 20 that heats air in the circulation channel 15 by a burner 25 (see FIG. 2). Thus, the air heated by the burner 25 is circularly supplied into the drying chamber 11. Note that part of the circulation channel 15 that introduces air from the drying chamber 11 to the burning mechanism 20 functions as an air introduction channel 16, and part of the circulation channel 15 that returns air form the burning mechanism 20 back to the drying chamber 11 functions as an air return channel 17.

Figure 3A:
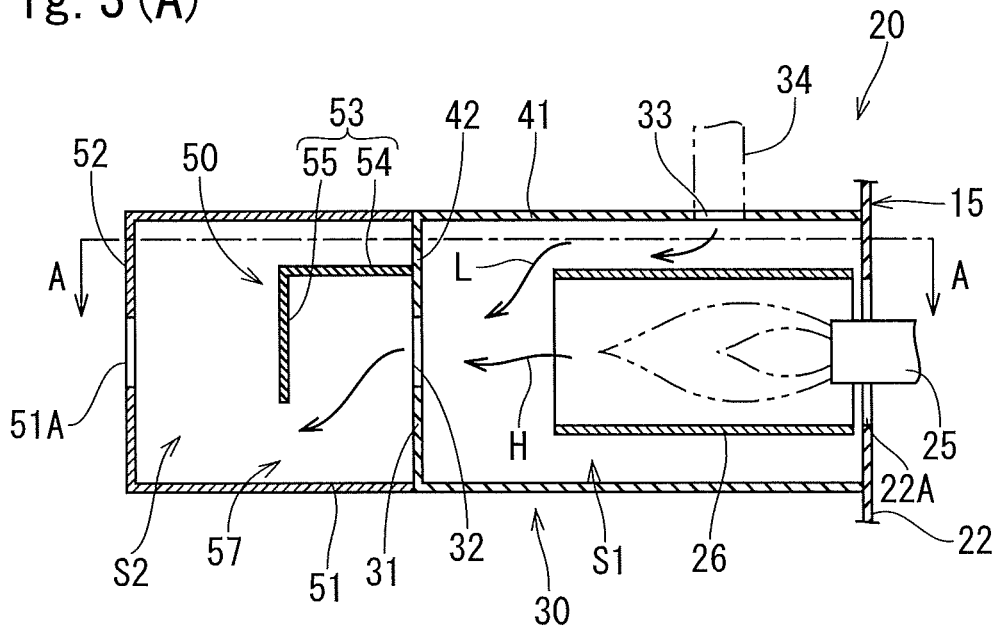
FIGS. 3A and 3B are respectively a side sectional view and a sectional view taken along line A-A of the casing and the flame holding cylinder.

Hereinafter, the burning mechanism 20 will be described in detail. As shown in FIGS. 1 and 3A, a burner device 25S including the burner 25 is provided adjacent to the circulation channel 15, and the burner 25 is inserted through a burner insertion hole 22A formed in a wall part 22 constituting the circulation channel 15, and enters into the circulation channel 15. With this arrangement, the air in the circulation channel 15 is heated by the burner 25. Note that the burner device 25S is a so-called gas burner, and includes, in addition to the burner 25, a fuel supply unit (not shown) that supplies fuel gas to the burner 25 and an air supply channel (not shown) that supplies air to the burner 25, Further, the paint drying oven 10 includes a thermometer 18 provided on the air introduction channel 16 or on the air return channel 17, and the burner device 25S controls a power of the burner 25, based on a measurement result of the thermometer 18. Note that FIG. 1 shows an example in which the thermometer 18 is provided on the air introduction channel 16.

As shown in FIG. 3A, the burning mechanism 20 includes a flame holding cylinder 26 that surrounds a flame of the burner 25 and a casing 30 that surrounds the flame holding cylinder 26 from outside. Both ends of the flame holding cylinder 26 are opened, and the flame holding cylinder 26 extends in an axial direction of the burner insertion hole 22A. In detail, the flame holding cylinder 26 faces the wall part 22 having the burner insertion hole 22A from inside the circulation channel 15, and has a small gap between the flame holding cylinder 26 and the wall part 22. Hereinafter, the side from which the flame holding cylinder 26 enters into the circulation channel 15 in an axial direction of the flame holding cylinder 26 is referred to as "front end side" or "front side", and the opposite side is referred to as "base end side" or "rear side".

The casing 30 has a cylindrical shape extending in the axial direction of the flame holding cylinder 26, and a rear end (base end) of the casing 30 is closed by the wall part 22 constituting the circulation channel 15. The casing 30 has an axial length longer than the flame holding cylinder 26, and extends further than the flame holding cylinder 26 toward the front end side. Note that in the example shown in FIGS. 3A and 3B, the casing 30 and the flame holding cylinder 26 are arranged coaxially with each other, but may be arranged with a central axis of the casing 30 and a central axis of the flame holding cylinder 26 shifted from each other.

In part of the casing 30 that surrounds the flame holding cylinder 26 from outside (the upper part of the flame holding cylinder 26 in the example in FIG. 3A), there is formed a low temperature air inlet port 33 to introduce low temperature air L into the casing 30. Specifically, as shown in FIG. 1, the paint drying oven 10 includes a low temperature air supply device 35 to take in low temperature air L from outside to supply the low temperature air L into the casing 30, and a low temperature air supply pipe 34 extending from the low temperature air supply device 35 is connected to the low temperature air inlet port 33. Further, in the present embodiment, the high temperature air H heated by the burner 25 and the low temperature air L introduced from the low temperature air inlet port 33 join together inside the casing 30.

As shown in FIG. 3A, on a front end part of the casing 30, an exhaust port 51A is formed to exhaust the high temperature air H and the low temperature air L in the casing 30 to the circulation channel 15. In the present embodiment, the casing 30 has a shape having a bottom at one end and a cylinder bottom wall 52 on the front end side, and the exhaust port 51A is formed on the cylinder bottom wall 52. That is, the exhaust port 51A is formed on a front end face of the casing 30. In the example shown in FIG. 3A, the exhaust port 51A is arranged coaxially with the flame holding cylinder 26. Note that in the present embodiment, air of the same volume as that of the introduced low temperature air L is exhausted outside, for example, at a middle of the air introduction channel 16.

In the present embodiment, inside the casing 30, there is provided a mixing mechanism 50 to mix the high temperature air H and the low temperature air L before being exhausted from the exhaust port 51A, and this arrangement can reduce the variation in the temperature of the air to be supplied into the drying chamber 11. Hereinafter, the mixing mechanism 50 will be described in detail.

The mixing mechanism 50 of the present embodiment has a downward guide wall 53 that guides the high temperature air H and the low temperature air L downward. With this arrangement, the mixing mechanism 50 can move the high temperature air H downward, which tends to stay in an upper part, and the high temperature air H and the low temperature air L can thus be mixed easily.

Specifically, in the present embodiment, a partition wall 31 is provided in the casing 30 to divide the inner space of the casing 30 into two spaces in the axial direction, thereby partitioning off the inner space into a base-end-side space S1 and a front-end-side space S2. In the partition wall 31, a communication hole 32 is formed to communicate between the base-end-side space S1 and the front-end-side space S2. The flame holding cylinder 26 is arranged in the base-end-side space S1, and the low temperature air inlet port 33 is communicated with the base-end-side space S1. The mixing mechanism 50 is provided in the front-end-side space S2. In the example shown in FIG. 3A, the communication hole 32 is arranged coaxially with the exhaust port 51A.

The above-described downward guide wall 53 includes an upper cover plate 54 that covers an area ahead of the communication hole 32 from above and a front cover plate 55 that hangs down from the upper cover plate 54 and covers the communication hole 32 from ahead. Note that, in the example shown in FIG. 3A, since the communication hole 32 is arranged coaxially with the exhaust port 51A, the downward guide wall 53 causes the high temperature air H and the low temperature air L introduced from the communication hole 32 toward the front-end-side space S2 to take a downward detour.

Figure 3B:
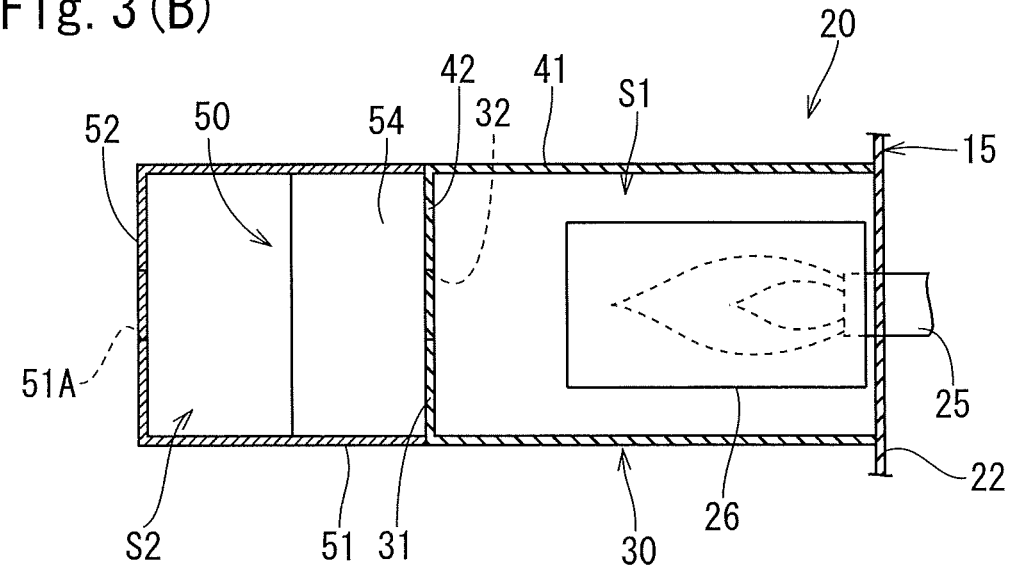

In addition, in the present embodiment, the casing 30 has a square cylindrical shape, and the upper cover plate 54 and the front cover plate 55 are arranged entirely in the width direction of the casing 30 (see FIG. 3B). With this arrangement, there is no gap on the sides of the upper cover plate 54 and the front cover plate 55 for the high temperature air H and the low temperature air L to enter into, so that both the high temperature air H and the low temperature air L are surely guided downward. In addition, the front cover plate 55 narrows an air passage that the high temperature air H and the low temperature air L exhausted from the communication hole 32 flow through, in an up-down direction. In other words, in the present embodiment, part of the front-end-side space S2 sandwiched between the front cover plate 55 and a lower end wall of the casing 30 constitutes a compressing section 57 that reduces a cross-sectional area of the air passage that the high temperature air H and the low temperature air L flow through.

Here, in the present embodiment, the casing 30 is configured with a cylindrical case 41 containing the flame holding cylinder 26 and an extension cylinder 51 provided to extend from the front end of the cylindrical case 41. The cylindrical case 41 has a cylindrical shape having a bottom at one end, and the front end of the cylindrical case 41 is closed by a front-end cover 42. The front-end cover 42 constitutes the above-described partition wall 31. Further, the cylindrical case 41 constitutes the above-described base-end-side space S1, and the extension cylinder 51 constitutes the above-described front-end-side space S2. Further, the mixing mechanism 50 is provided inside the extension cylinder 51.

The structure of the paint drying oven 10 according to the present embodiment has been described above. Next, operation and effect of the paint drying oven 10 will be described.

In the paint drying oven 10 of the present embodiment, the low temperature air L is introduced into the casing 30 from the low temperature air inlet port 33 provided on the casing 30, and the high temperature air H heated by the burner 25 and the low temperature air L are exhausted from the exhaust port 51A provided on the front end part of the casing 30. Further, in the paint drying oven 10, the easing 30 includes the mixing mechanism 50 that mixes the high temperature air H and the low temperature air L before being exhausted from the exhaust port 51A. Specifically, the mixing mechanism 50 has the downward guide wall 53 that guides the high temperature air H and the low temperature air L downward. With this arrangement, it is possible to move the high temperature air H downward, which tends to stay in an upper part, and the high temperature air H and the low temperature air L can thus be mixed easily. Further, in the present embodiment, the downward guide wall 53 can make longer the air passage that the high temperature air H and the low temperature air L flow through, and the high temperature air H and the low temperature air L can thus be mixed more easily. In addition, in the present embodiment, since the mixing mechanism 50 has the compressing section 57 that narrows the cross-sectional area of the air passage that the high temperature air H and the low temperature air L flow through, the high temperature air H and the low temperature air L can also be mixed easily. As described above, in the paint drying oven 10 of the present embodiment, the mixing mechanism 50 enables the high temperature air H and the low temperature air L before being exhausted from the exhaust port 51A of the casing 30 to be mixed easily. Therefore, in the paint drying oven 10 of the present embodiment, the air having been mixed can be supplied into the drying chamber 11, therefore, the variation in the temperature of the air supplied into the drying chamber 11 can be reduced, and it is possible to reduce the production of defective products.

Further, in the present embodiment, when the high temperature sir H and the low temperature air L pass through the communication hole 32 formed in the partition wall 31, the high temperature air H and the low temperature air L are made to join together, and the high temperature air and the low temperature air after having been joined can be mixed by the mixing mechanism. Further, since the downward guide wall 53 includes the upper cover plate 54 covering, from above, the area ahead of the communication hole 32 formed in the partition wall 31 and the front cover plate 55 hanging down from the upper cover plate 54 and covering the communication hole 32 from ahead, the downward guide wall 53 can be realized with a simple structure.

Further, in the present embodiment, the casing 30 is configured with the cylindrical case 41 containing the flame holding cylinder 26 and having the low temperature air inlet port 33 and with the extension cylinder 51 provided to extend from the front edge of the cylindrical case 41, and the mixing mechanism 50 is provided in the extension cylinder 51. Therefore, it is possible to provide the casing 30 having the mixing mechanism 50 by attaching the extension cylinder 51 to the front end of the cylindrical case 41 provided on an existing paint drying oven.

Second Embodiment

Figure 4A:
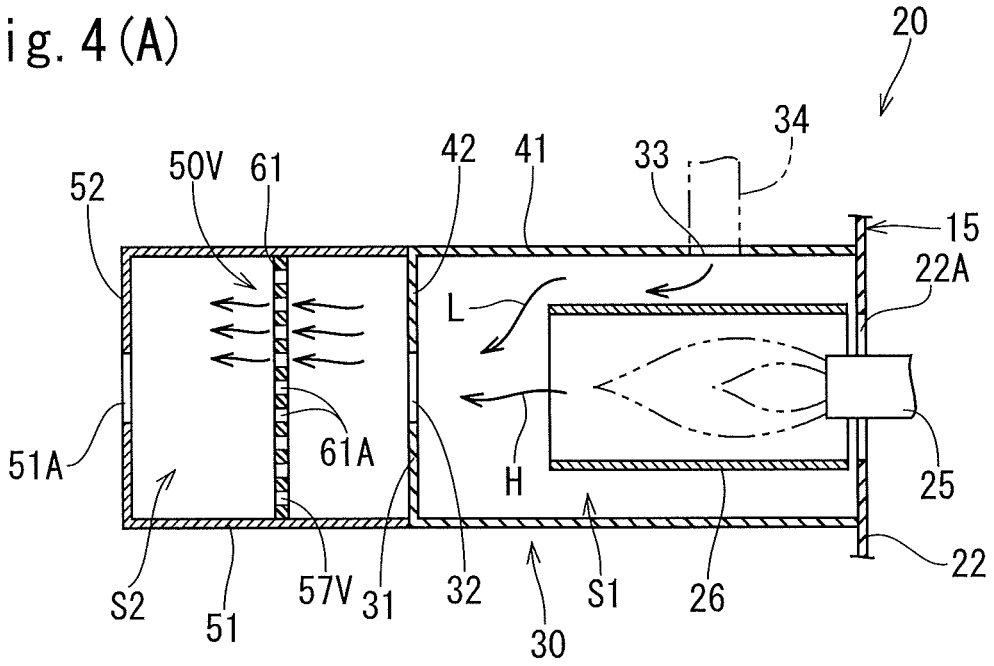
FIGS. 4A and 4B are respectively a side sectional view and a plane sectional view of a burning mechanism of a paint drying oven according to a second embodiment.
Figure 4B:
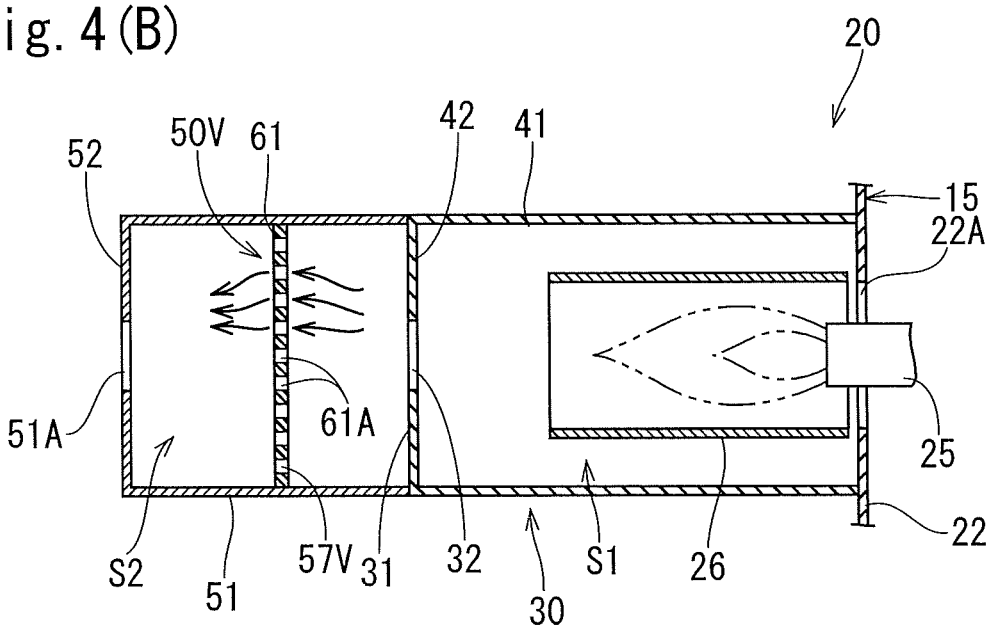

Hereinafter, a second embodiment of the present invention will be described with reference to FIGS. 4A and 4B. The present embodiment is a modification of the above mixing mechanism 50 of the first embodiment. As shown in FIGS. 4A and 4B, a mixing median 50V of the present embodiment figured with a punched plate 61 arranged to cross an axial direction of a casing 30 (that an axial direction of a flame holding cylinder 26). Note that the punched plate 61 is in internal contact with the casing 30, and there is formed no gap between the casing 30 and the punched plate 61 for the high temperature air H and the low temperature air L to enter into.

In the present embodiment, flows of the high temperature air H and the low temperature air L in the casing 30 are narrowed down by a plurality of punched holes 61A formed in the punched plate 61 (see FIG. 4A). Being narrowed down, the high temperature air H and the low temperature air L can be mixed easily, and, as a result, the variation in the temperature of the air to be supplied into the drying chamber 11 is reduced, whereby the production of defective products is reduced. Note that, in the present embodiment, the punched holes 61A constitutes a compressing section 57V to reduce the cross-sectional area of the air passage that the high temperature air H and the low temperature air L pass through.

Note that, also in the present embodiment, similarly to the above embodiment, a partition wall 31 is provided in the casing 30, and the mixing mechanism 50V is arranged in the front-end-side space S2 in the casing 30. In detail, the casing 30 is configured with a cylindrical case 41 and an extension cylinder 51, and the mixing mechanism 50V is arranged in the extension cylinder 51.

Third Embodiment

Figure 5A:
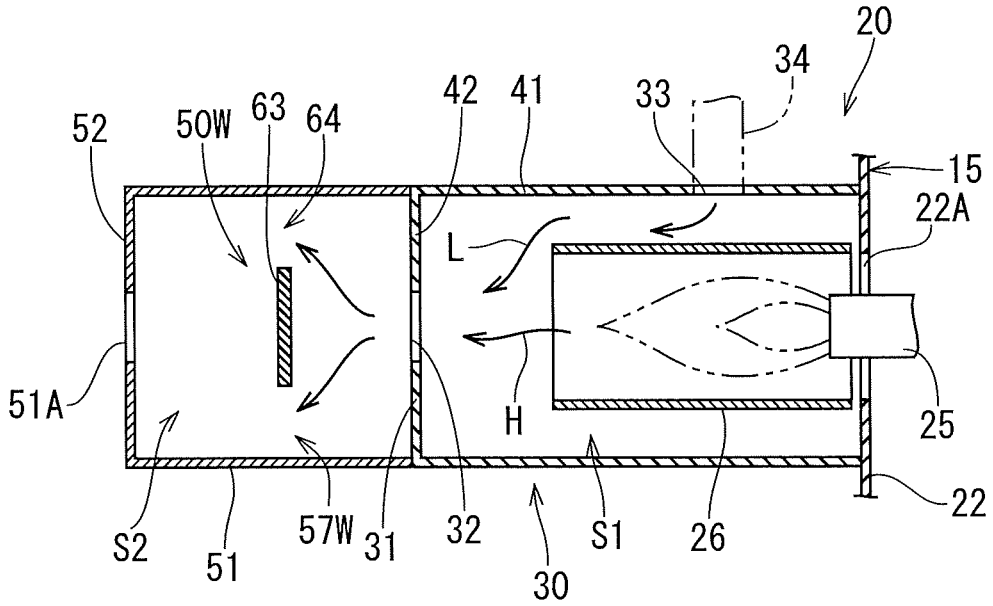
FIGS. 5A and 5B are respectively a side sectional view and a plane sectional view of a burning mechanism of a paint drying oven according to a third embodiment.
Figure 5B:
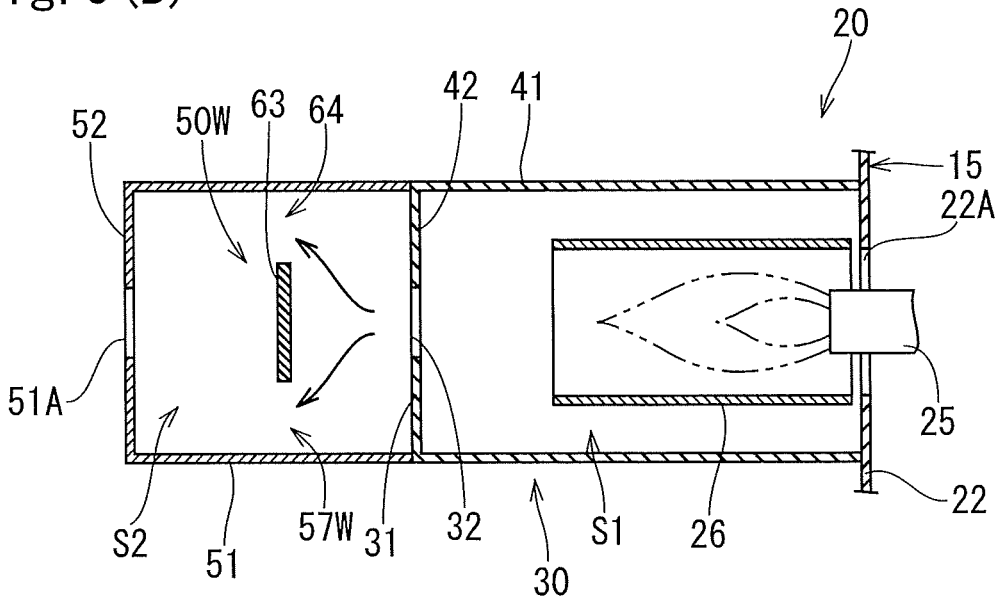

Hereinafter, a third embodiment of the present invention will be described with reference to FIGS. 5A and 5B. The present embodiment is a modification of the above mixing mechanism 50 of the first embodiment. As shown in FIGS. 5A and 5B, in the present embodiment, a mixing mechanism 50W is configured with a shield plate 63 arranged to cross an axial direction of a casing 30 (i.e., an axial direction of a flame holding cylinder 26). An area of the shield plate 63 is smaller than the cross-sectional area of the casing 30, and an annular gap 64 is formed between an inner peripheral surface of the casing 30 and the shield plate 63. Note that the shield plate 63 is supported by a supporting post (not shown) standing from the inner peripheral surface of the casing 30.

In the present embodiment, the high temperature air H and the low temperature air L in the burning chamber 30 flow into an exhaust port 51A of the casing 30, taking a detour and getting around the shield plate 63. In other words, in the present embodiment, the shield plate 63 makes the flows of the high temperature air H and the low temperature air L take a detour. This detour can make longer an air passage in which the high temperature air H and the low temperature air L flow in the casing 30, so that the high temperature air H and the low temperature air L can be mixed easily.

Further, in the present embodiment, in the casing 30, the air passage that the high temperature air H and the low temperature air L flow through is narrowed toward the outer sides of the casing 30 by the shield plate 63. In the present embodiment, this arrangement enables the high temperature air H and the low temperature air L to be mixed easily. Note that, in the present embodiment, the gap 64 constitutes a compressing section 57W that reduces the cross-sectional area of the air passage that the high temperature air H and the low temperature air L pass through.

Note that, also in the present embodiment, similarly to the above embodiments, a partition wall 31 is provided in the casing 30, and the mixing mechanism 50W is arranged in a front-end-side space S2 in the casing 30. In detail, the casing 30 is configured with a cylindrical case 41 and an extension cylinder 51, and the mixing mechanism 50W is arranged in the extension cylinder 51.

Fourth Embodiment

Figure 6A:
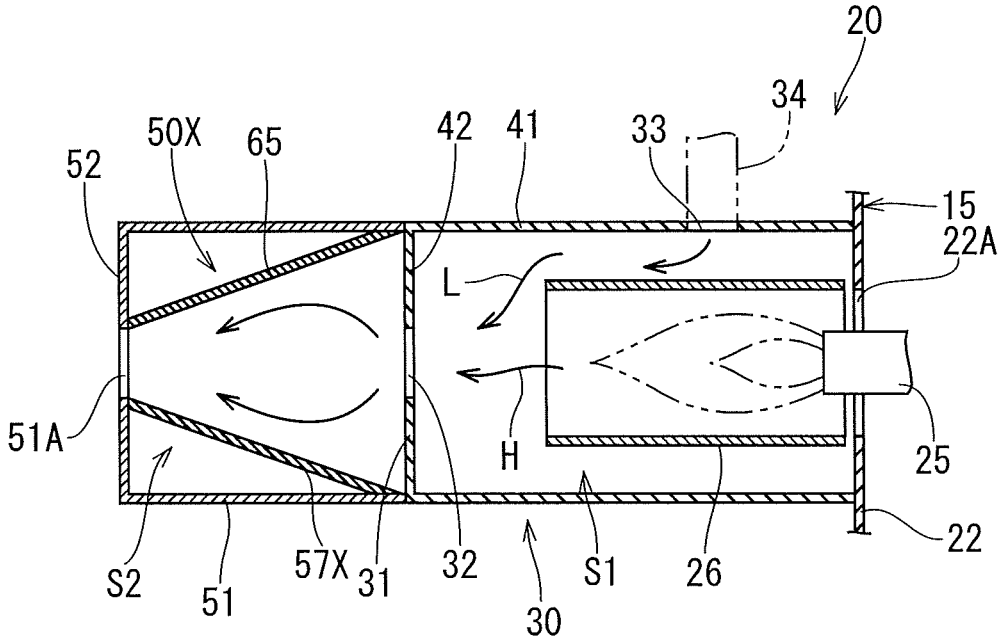
FIGS. 6A and 6B are respectively a side sectional view and a plane sectional view of a burning mechanism of a paint drying oven according to a fourth embodiment.
Figure 6B:
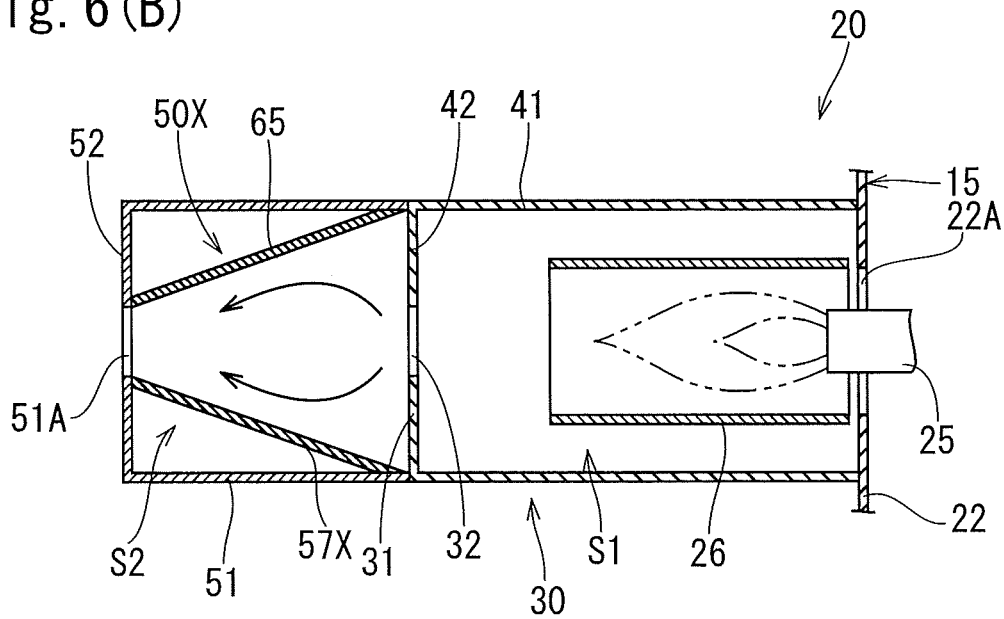

Hereinafter, a fourth embodiment of the present invention will be described with reference to FIGS. 6A and 6B. The present embodiment is a modification of the above mixing mechanism 50 of the first embodiment. As shown in FIGS. 6A and 6B, a mixing mechanism 50X of the present embodiment is configured with a narrowing part 65 provided inside a front end part of a casing 30. The narrowing part 65 has a cylindrical shape whose diameter decreases in the direction toward a front end side of the casing 30. Note that, in the example shown in FIGS. 6A and 6B, a gap is formed between the narrowing part 65 and the casing 30, but no gap may be formed.

In the present embodiment, the air passage that the high temperature air H and the low temperature air L flow through in the casing 30 is narrowed down by the narrowing part 65, and this arrangement enables the high temperature air H and the low temperature air L to be mixed easily. Note that, in the present embodiment, the narrowing part 65 constitutes a compressing section 57X that reduces the cross-sectional area of the air passage that the high temperature air H and the low temperature air L flow through.

Note that, also in the present embodiment, similarly to the above embodiments, a partition wall 31 is provided in the casing 30, and the mixing mechanism 50X is arranged in a front-end-side space S2 in the casing 30. In detail, the casing 30 is configured with a cylindrical case 41 and an extension cylinder 51, and the mixing mechanism 50X is arranged in the extension cylinder 51. In the example shown in FIGS. 6A and 6B, the narrowing part 65 functioning as the mixing mechanism 50X is arranged entirely in the axial direction of the extension cylinder 51.

Fifth Embodiment

Figure 7A:
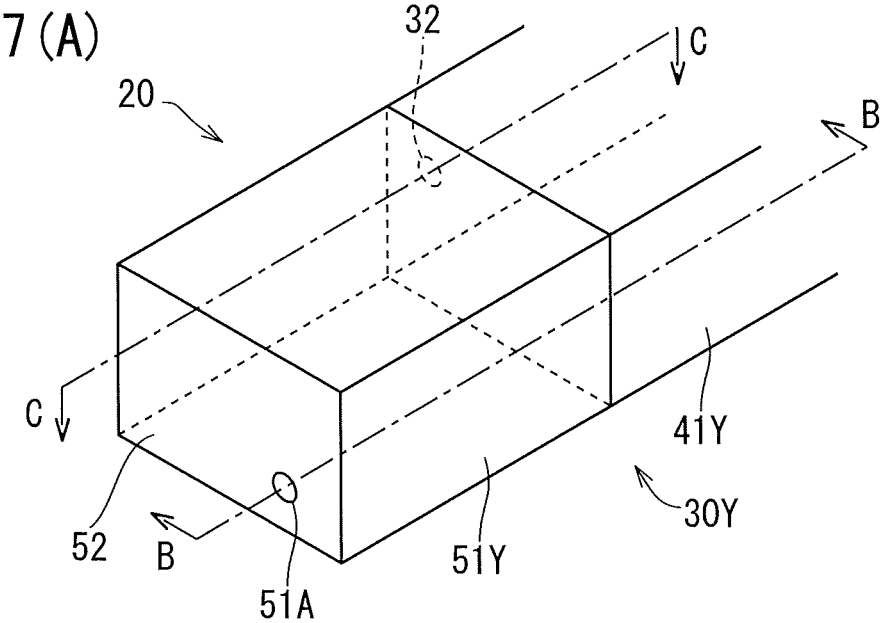
FIGS. 7A, 7B, and 7C are respectively a perspective view, a sectional view taken along line B-B, and a sectional view taken along line C-C of a burning mechanism of a paint drying oven according to a fifth embodiment.
Figure 7B:
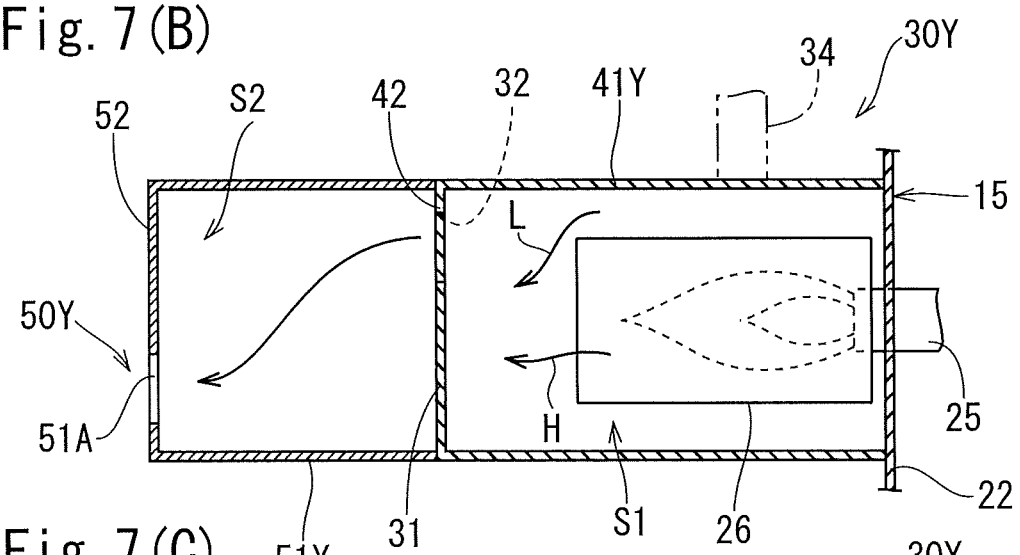
Figure 7C:
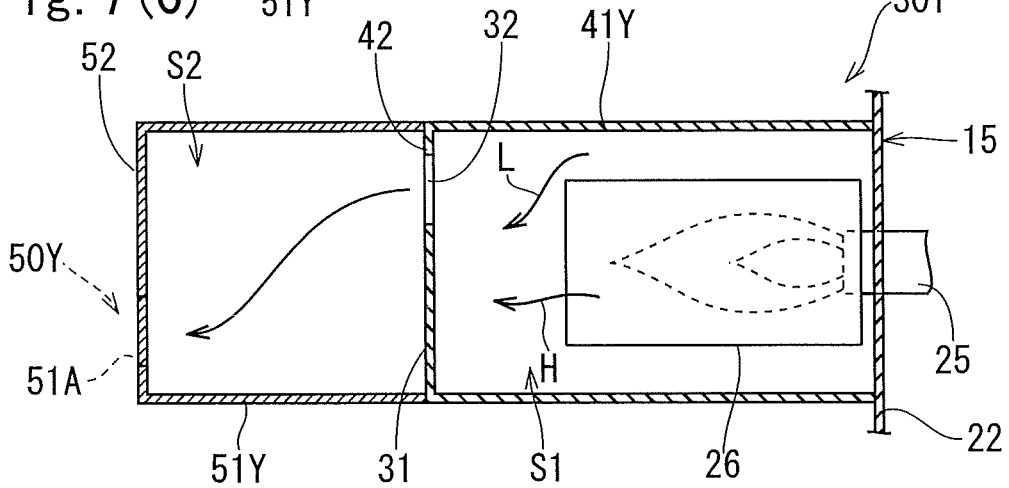

Hereinafter, a fifth embodiment of the present invention will be described with reference to FIGS. 7A to 7C. The present embodiment is a modification of the casing 30 of the above first embodiment, and the other components are similar to the components in the above first embodiment. As shown in FIG. 7A, a casing 30Y of the present embodiment does not include the downward guide wall 53 inside the casing 30Y. Further, as shown in FIGS. 7B and 7C, an exhaust port 51A of the casing 30Y is arranged at a position shifted from a communication hole 32 formed in a partition wall 31 when viewed in the axial direction of the casing 30Y. Specifically, the communication hole 32 of the partition wall 31 is arranged on the upper side and on one side in the left-right direction on the partition wall 31, and the exhaust port 51A of the casing 30Y is arranged on the lower side and on the other side in the left-right direction on the cylinder bottom wall 52 (see FIG. 7A).

In the present embodiment, the high temperature air H and the low temperature air L having passed through the communication hole 32 of the partition wall 31 go through a front-end-side space S2, and are exhausted from the exhaust port 51A. Here, since the exhaust port 51A is arranged at a position shifted from the communication hole 32 when viewed in the axial direction of the casing 30Y, the high temperature air H and the low temperature air L flow in the front-end-side space S2 in a direction oblique to the axial direction of the casing 30Y, whereby the air passage that the high temperature air H and the low temperature air L flow through is longer than that when the communication hole 32 and the exhaust port 51A are coaxially arranged. With this arrangement, the high temperature air H and the low temperature air L having passed through the communication hole 32 can be mixed easily in the front-end-side space S2. Note that, in the present embodiment, the mixing mechanism 50Y is configured with the front-end-side space S2 communicating with the communication hole 32 and the exhaust port 51A that are arranged to be shifted from each other when viewed in the axial direction of the casing 30Y.

Note that, also in the present embodiment, similarly to the above embodiments, the casing 30 is configured with a cylindrical case 41Y and an extension cylinder 51Y, and the mixing mechanism 50Y is arranged in the extension cylinder 51Y.

Sixth Embodiment

Figure 8:
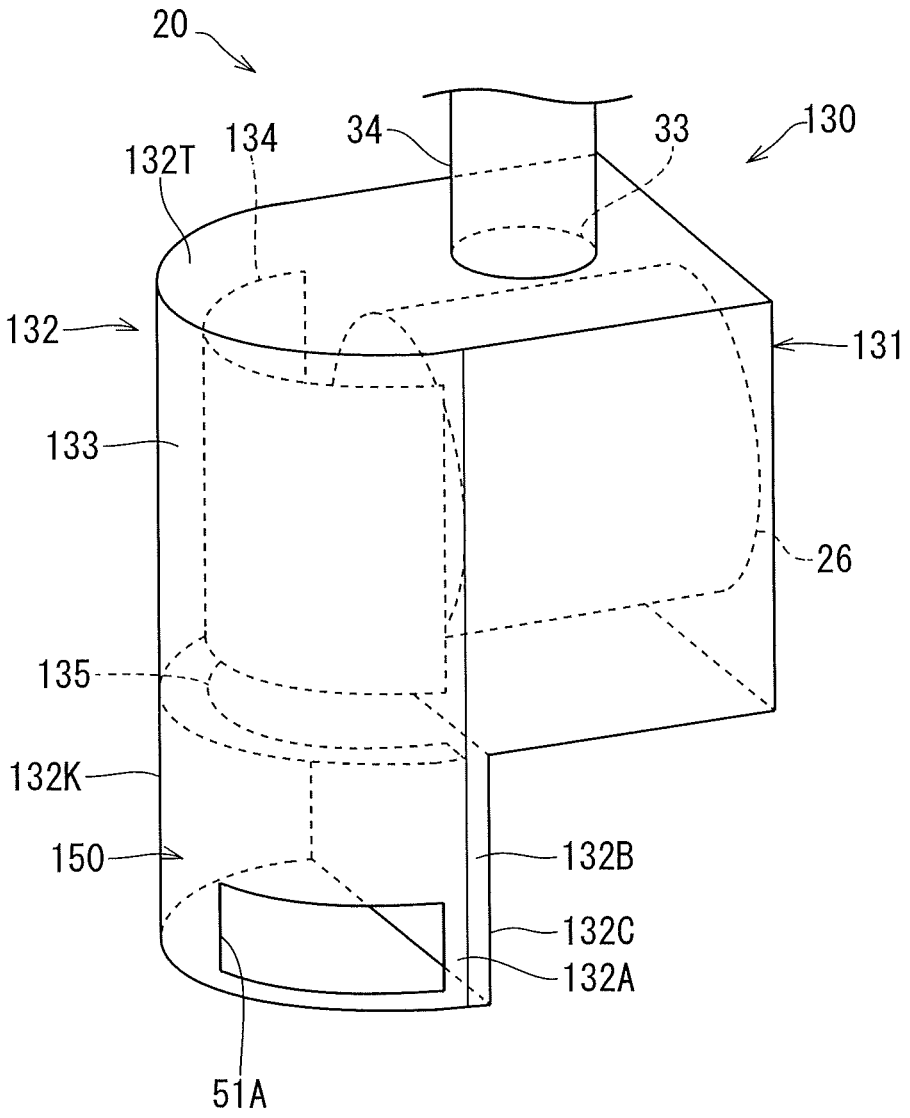
FIG. 8 is a perspective view of a casing according to a sixth embodiment.

Hereinafter, a sixth embodiment of the present invention will be described with reference to FIGS. 8 to 9B. The present embodiment is a modification of the above first embodiment, and the structure of a casing 130 is different from structure of the casing 30 of the above first embodiment, as shown in FIG. 8. Hereinafter, a specific configuration of the casing 130 will be described.

Figure 9A:
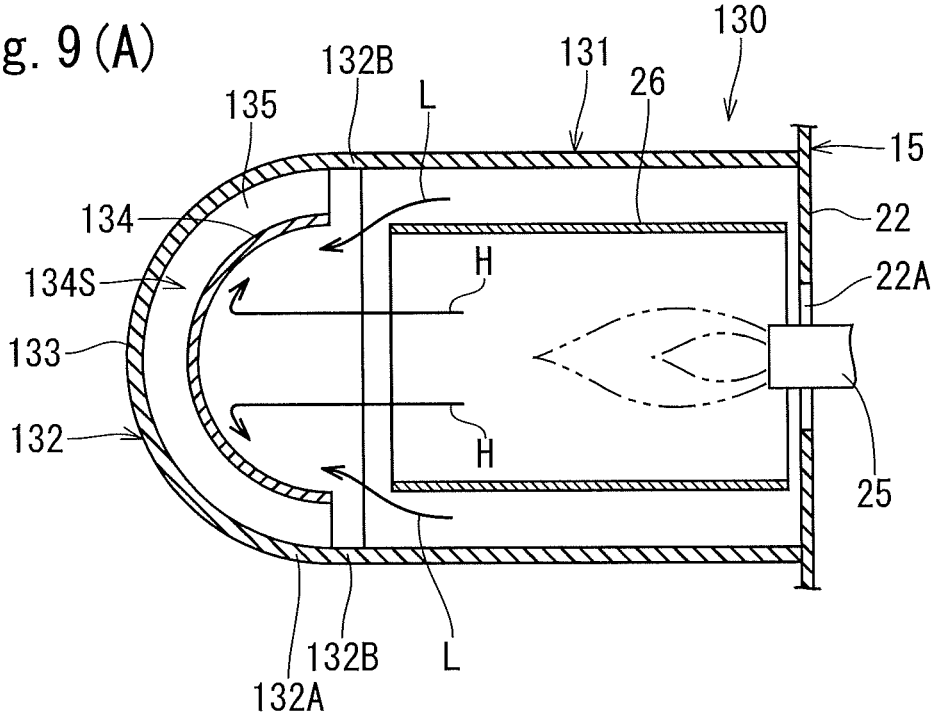
FIGS. 9A and 9B are respectively a plane sectional view and a side sectional view of the casing.
Figure 9B:
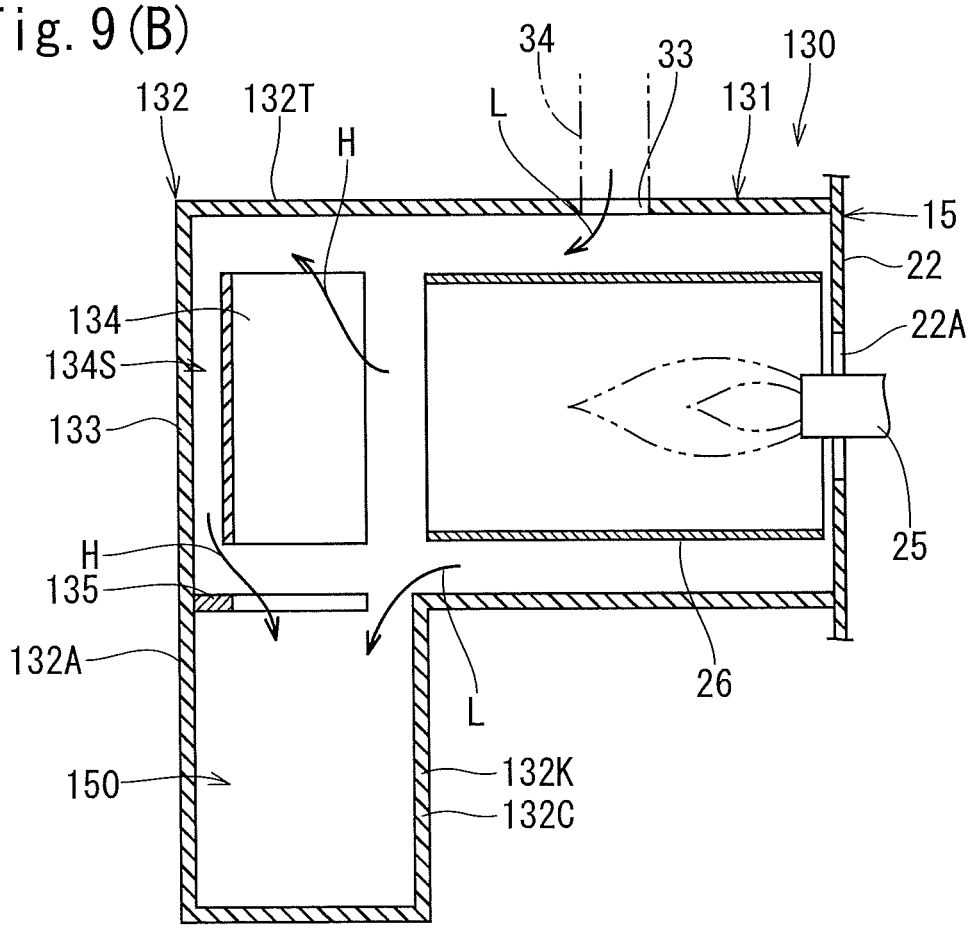

As shown in FIGS. 8 and 9B, the casing 130 has an approximate L-shaped structure in which a front end part of a horizontal cylinder part 131 extending in the horizontal direction (i.e., the axial direction of a flame holding cylinder 26) and an upper end part of a vertical cylinder part 132 extending in the vertical direction are connected to each other. The horizontal cylinder part 131 receives the flame holding cylinder 26 inside the horizontal cylinder part 131, and a low temperature air inlet port 33 is formed on a peripheral wall of the horizontal cylinder part 131 (in the example in FIGS. 8 and 9B, the low temperature air inlet port 33 is formed on the upper part of the horizontal cylinder part 131). The vertical cylinder part 132 has a downward projection part 132K that projects lower than the horizontal cylinder part 131. On the downward projection part 132K, an exhaust port 51A is formed to exhaust the high temperature air H and the low temperature air L in the casing 130.

In the present embodiment, the vertical cylinder part 132 has a semi-circular shape that swells out toward a distal side from the horizontal cylinder part 131 when viewed in the axial direction (see FIG. 9A). Further, on a peripheral wall of the vertical cylinder part 132, there is provided a front-end facing wall 133 that faces, from the front end side, the flame holding cylinder 26 received in the horizontal cylinder part 131. In the vertical cylinder part 132, there is provided a heat shield plate 134 that extends along the front-end facing wall 133 and covers the flame holding cylinder 26 from the front end side. The heat shield plate 134 reduces deterioration of the front-end facing wall 133 caused by a direct hit, of the high temperature air H flowing front the flame holding cylinder 26, on the front-end facing wall 133. Note that the heat shield plate 134 has a gap between the heat shield plate 134 and a ceiling wall 132T of the vertical cylinder part 132. Owing to this gap, the high temperature air H having moved upward in the vertical cylinder part 132 can move downward, passing between the heat shield plate 134 and the front-end facing wall 133.

As shown in FIG. 9B, inside the vertical cylinder part 132, there are provided, in addition to the heat shield plate 134, a partition plate 135 projecting inward from the front-end facing wall 133. The partition plate 135 is arranged below the heat shield plate 134, and covers a gap 134S between the front-end facing wall 133 and the heat shield plate 134 from below. In detail, as shown in FIG. 9A, an projection length of the partition plate 135 from the front-end facing wall 133 is equal to or greater than a width of the gap 134S. Further, the partition plate 135 is extended entirely in the circumferential direction of the front-end facing wall 133.

Note that, in the present embodiment, the peripheral wall of the vertical cylinder part 132 is configured with a semi-circular arc wall 132A constituting the above front-end facing wall 133, a pair of extension walls 132B and 132B that are provided to extend, from both ends of the circular arc wall 132A, in the axial direction of the flame holding cylinder 26 and that communicate with the peripheral wall of the horizontal cylinder part 131, where the both ends of the circular arc wall 132A are arranged to sandwich the flame holding cylinder 26 and a communication wall 132C that communicates between each of lower end parts of the pair of extension walls 132B and 132B and that communicates with a bottom end of the horizontal cylinder part 131 (see FIG. 8). The exhaust port 51A is formed on the lower end part of the circular arc wall 132A.

The configuration of the casing 130 has been described above. Note that the configuration of the part other than the casing 130 of the paint drying oven 10 of the present embodiment is the same as the above first embodiment, so that the same reference numerals are assigned to omit the same description.

Next, operation and effect of the paint drying oven 10 of the present embodiment will be described. In the present embodiment, the low temperature air L is introduced into the casing 130 from the low temperature air inlet port 33 provided on the casing 130, and the high temperature air H heated by the burner 25 and the low temperature air L are exhausted from the exhaust port 51A provided on the front end part of the casing 130. Specifically, the low temperature air inlet port 33 is provided on the horizontal cylinder part 131 in the casing 130 receiving the flame holding cylinder 26. The high temperature air H and the low temperature air L flow from the horizontal cylinder part 131 to the vertical cylinder part 132 in the casing 130. Here, since the exhaust port 51A is provided on a downward projection part 132K projecting lower than the horizontal cylinder part 131 in the vertical cylinder part 132, the high temperature air H and the low temperature air L flowing from the horizontal cylinder part 131 move downward in the vertical cylinder part 132. In other words, the vertical cylinder part 132 constitutes a mixing mechanism 150 that moves the high temperature air H and the low temperature air L downward, and then mixes the high temperature air H and the low temperature air L.

With the present embodiment, in the same manner as in the above embodiments, it is possible to mix the high temperature air H and the low temperature air L in the casing 130 and to supply the mixed air into the drying chamber 11, therefore, it is possible to reduce the variation in the temperature of the air supplied into the drying chamber 11 and to reduce the production of defective products.

Further, in the present embodiment, since the vertical cylinder part 132 has a semi-circular shape that swells out toward the distal side from the horizontal cylinder part 131, the high temperature air H and the low temperature air L flowing from the horizontal cylinder part 131 toward the vertical cylinder part 132 are made to circulate along the peripheral wall of the vertical cylinder part 132, and a residence time of the high temperature air H and the low temperature air L in the vertical cylinder part 132 can therefore be long, whereby the high temperature air H and the low temperature air L can be mixed easily. Further, in the present embodiment, since the high temperature air H flowing to the upper part of the vertical cylinder part 132 and then passing downward between the heat shield plate 134 and the front-end facing wall 133 (circular arc wall 132A) is guided by the partition plate 135 toward a horizontal cylinder part 131 side, the high temperature air H can be easily mixed with the low temperature air L flowing from the horizontal cylinder part 131.

Seventh Embodiment

Figure 10:
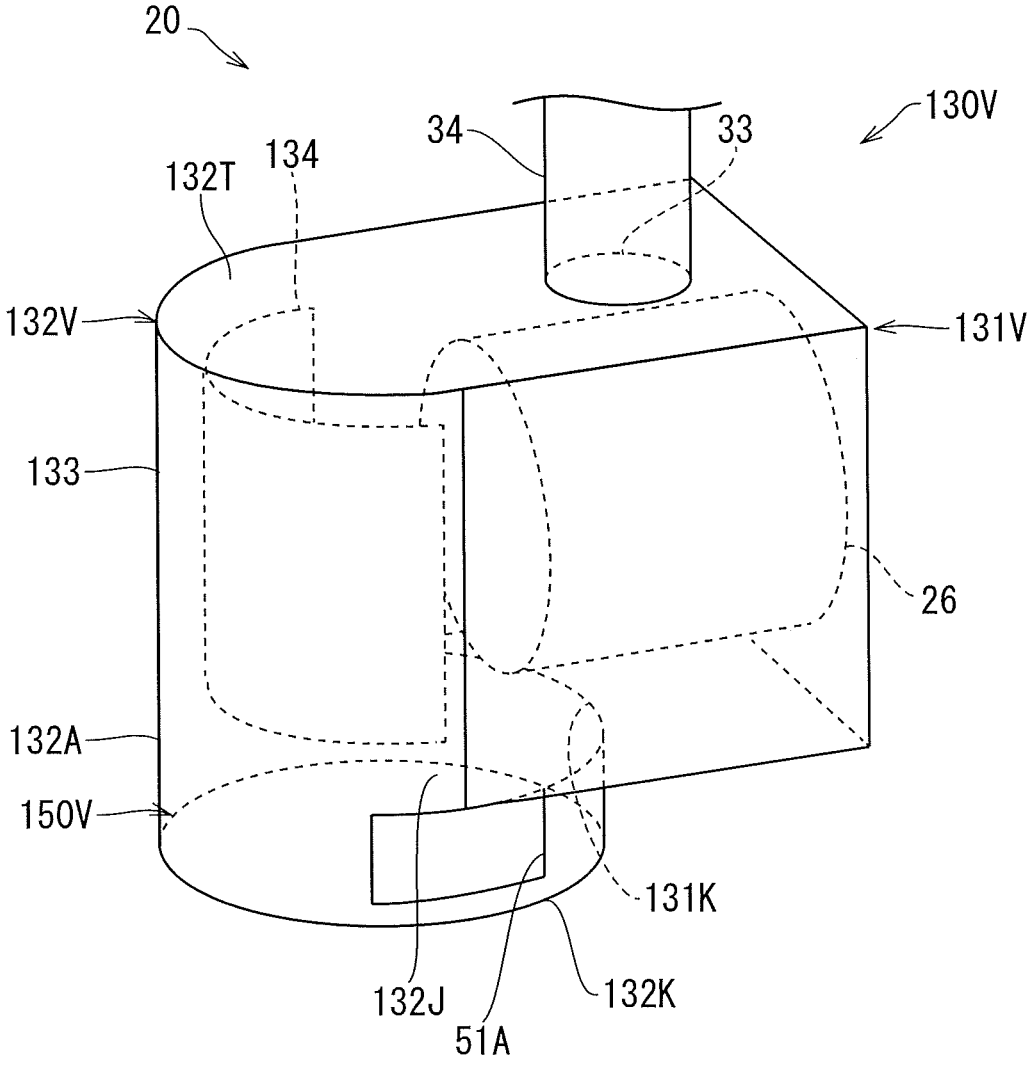
FIG. 10 is a perspective view of a casing according to a seventh embodiment.

Hereinafter, a seventh embodiment of the present invention will be described with reference to FIGS. 10 to 11B. The present embodiment is a modification of the casing 130 of the above sixth embodiment. As shown in FIGS. 10 and 11B, a casing 130V of the present embodiment has an approximate L-shaped structure in which a horizontal cylinder part 131V and a vertical cylinder part 132V are connected together. Similarly to the above sixth embodiment, the horizontal cylinder part 131V receives a flame holding cylinder 26 inside the horizontal cylinder part 131V, and includes a low temperature air inlet port 33. Further, the vertical cylinder part 132V has a downward projection part 132K projecting lower than the horizontal cylinder part 131V, and has an exhaust port 51A on the downward projection part 132K.

Figure 11A:
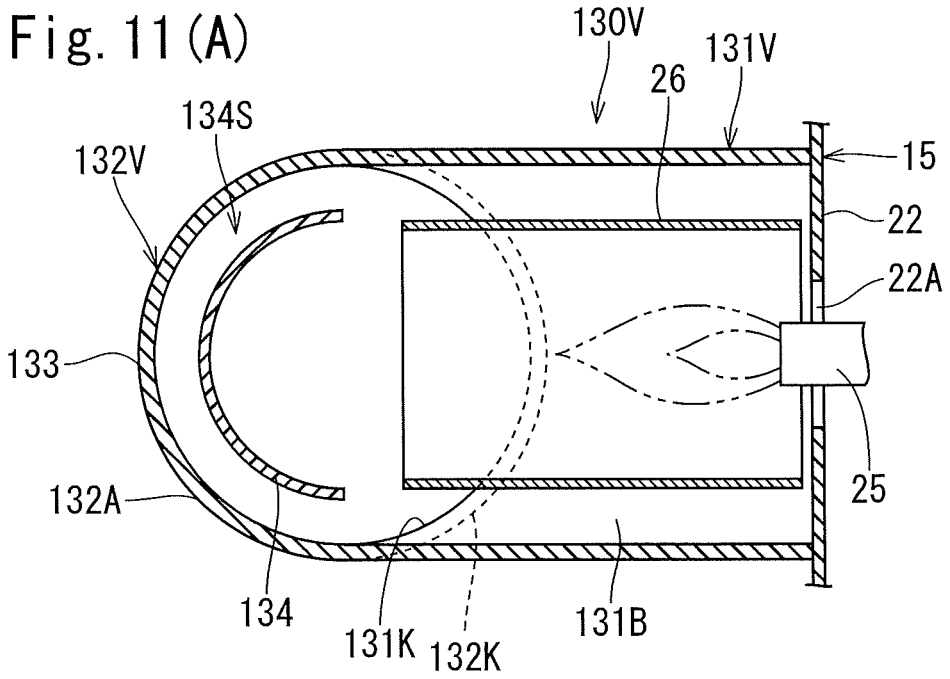
FIGS. 11A and 11B are respectively a plane sectional view and a side sectional view of the casing.
Figure 11B:
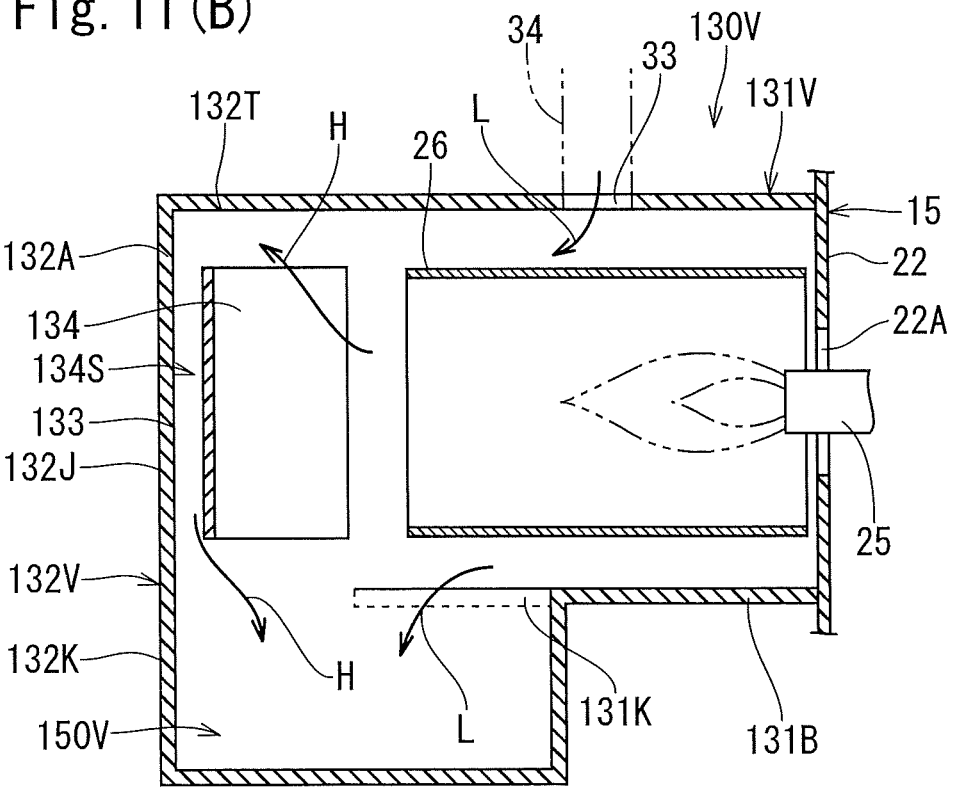

In the present embodiment, the vertical cylinder part 132V has a circular shape when viewed in the axial direction (see FIG. 11A). In detail, in the vertical cylinder part 132V, the downward projection part 132K is formed in a circular shape, and an upper-side connection part 132J is configured with part above the downward projection part 132K of the vertical cylinder part 132V, and has a semi-circular shape that swells out toward the distal side from the horizontal cylinder part 131V. Here, on a front end part of a bottom wall 131B of the horizontal cylinder part 131V, there is formed a semi-circular cutout part 131K that swells out in the direction toward the base end side, and a semi-circular part, of a peripheral wall of the downward projection part 132K, on the side closer to the horizontal cylinder part 131V is connected to an edge part of the cutout part 131K.

Further, in the present embodiment, a length in an up-down direction of the downward projection part 132K of the casing 130V is shorter than the length in an up-down direction of the downward projection part 132K of the casing 130 of the above sixth embodiment. Further, the casing 130V of the present embodiment is different from the casing 130 of the above sixth embodiment in that the casing 130V does not include the partition plate 135 in the vertical cylinder part 132V.

Note that the upper-side connection part 132J of the vertical cylinder part 132V is configured with a ceiling wall 132T and a circular arc wall 132A provided to extend from the peripheral wall of the downward projection part 132K, and both end parts of the circular arc wall 132A communicates with side walls of the horizontal cylinder part 131V. The circular arc wall 132A constitutes a front-end facing wall 133 that faces the flame holding cylinder 26 from the front end side. Further, in the vertical cylinder part 132V, a heat shield plate 134 is provided to extend along the front-end facing wall 133 (circular arc wall 132A).

The configuration of the casing 130V of the present embodiment has been described above. The present embodiment can provide an effect similar to that of the above sixth embodiment, Note that, in the present embodiment, the vertical cylinder part 132V of the casing 130V constitutes a mixing mechanism 150V that mixes the high temperature air H and the low temperature air L.

Other Embodiments

The present invention is not limited to the above embodiments. For example, the embodiments to be described below are included in the technical scope of the present invention, and, also in other embodiments than the following embodiments, the present invention can be carried out with various modifications without departing from the spirit of the present invention.

(1) In the above first to fifth embodiments, the casings 30 and 30Y respectively include the cylindrical cases 41, 41Y and the extension cylinders 51, 51Y as separated bodies, however, the separate components may be provided as a single body. Specifically, the casings 30 and 30Y each may be configured with a single cylindrical body. In this case, in the above first to fourth embodiments, the partition wall 31 may not be provided in the casing 30.

Figure 12A:
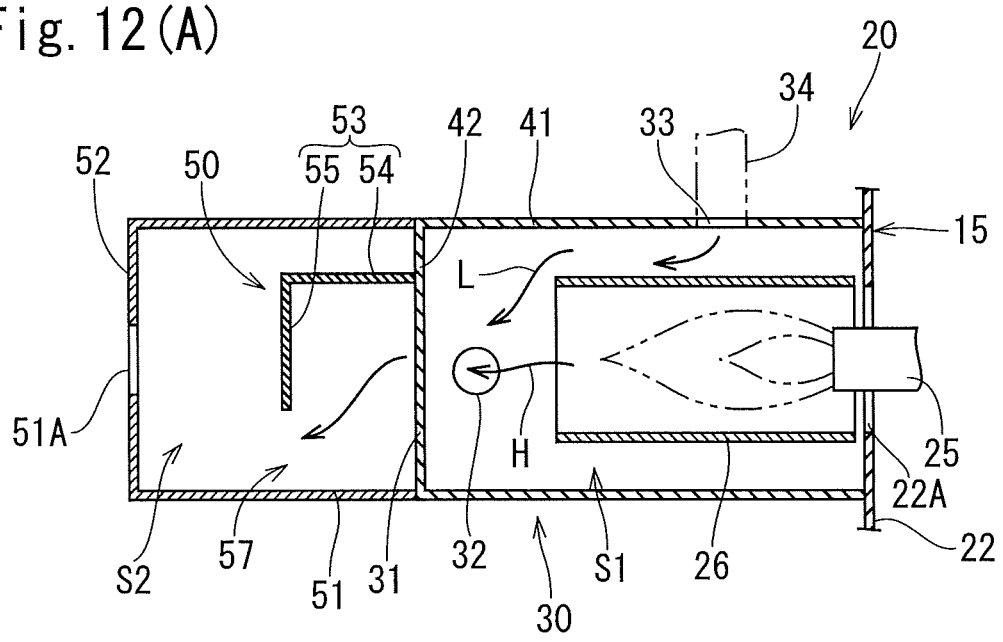
FIGS. 12A and 12B are respectively a side sectional view and a plane sectional view of a casing according to a modified example.
Figure 12B:
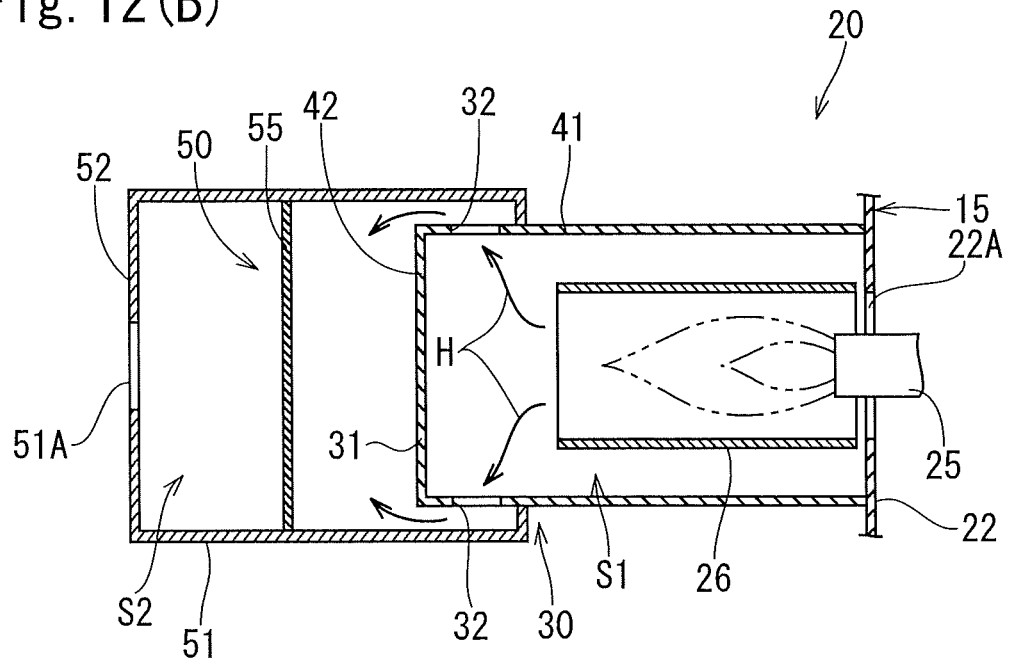
Figure 13A:
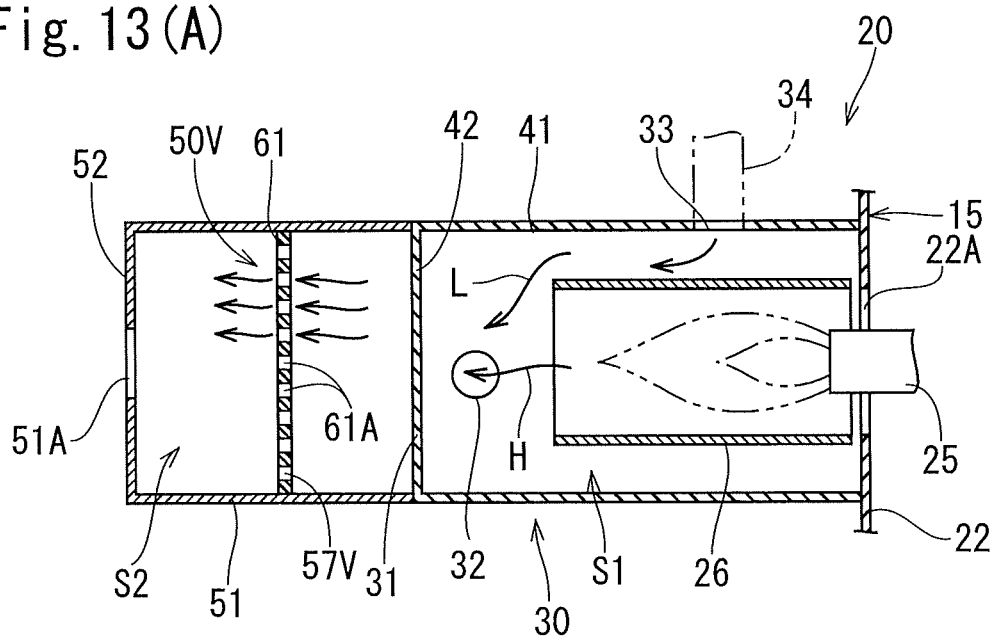
FIGS. 13A and 13B are respectively a side sectional view and a plane sectional view of a casing according to a modified example.
Figure 13B:
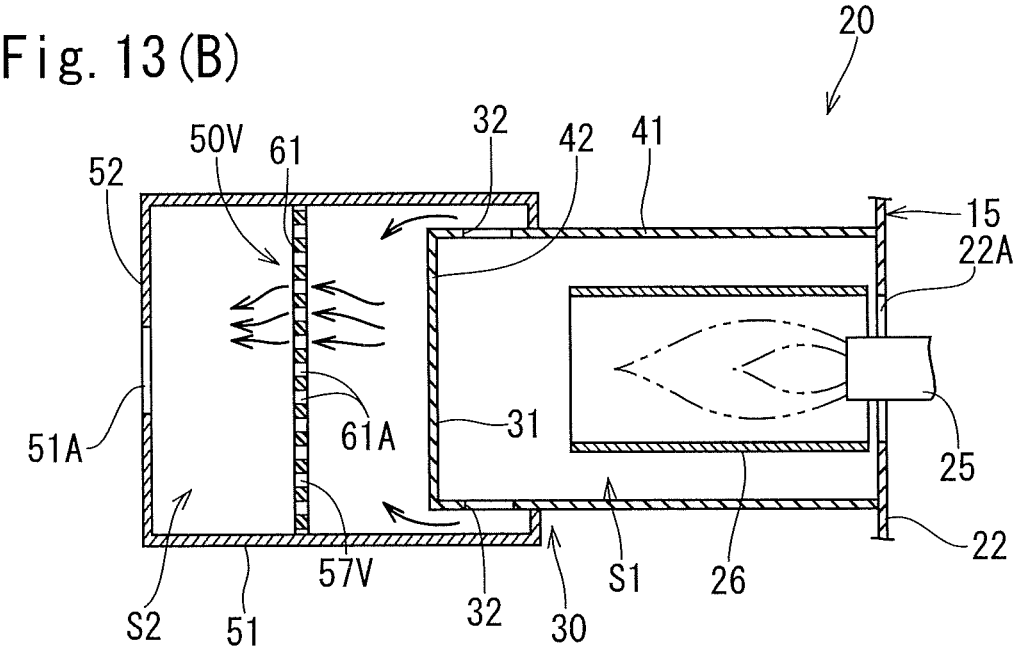

(2) in the above first to fifth embodiments, the communication hole 32 only has to be formed in the front end parts of the cylindrical cases 41 and 41Y, and, for example, the communication hole 32 may be formed in outer circumferential surfaces of the cylindrical cases 41 and 41Y. In that case, the sizes and the shapes of the extension cylinders 51, 51Y and the mixing mechanisms 50 to 50Y may be changed depending on the positions of the communication holes 32. Note that FIGS. 12A and 12B show an example in which the present configuration is applied to the above first embodiment, and FIGS. 13A and 13B show an example in which the present configuration is applied to the above second embodiment.

(3) In the above embodiment, the low temperature air inlet port 33 is arranged on the upper parts of the casings 30, 30Y, 130, 130V, but may be on the side parts or the bottom parts. Note that, in the case that the low temperature air inlet port 33 is arranged on the upper parts of the casings 30, 30Y, 130, and 130V as the above embodiments, the low temperature air L, which tends to stay in the lower part, can be mixed easily with the high temperature air H.

(4) in the above first to fourth embodiments, the casing 30 may have a configuration without the cylinder bottom wall 52. In other words, the front end side of the casing 30 may be opened. In this case, the opening at the front end of the casing 30 constitutes the exhaust port 51A.

Figure 14B:
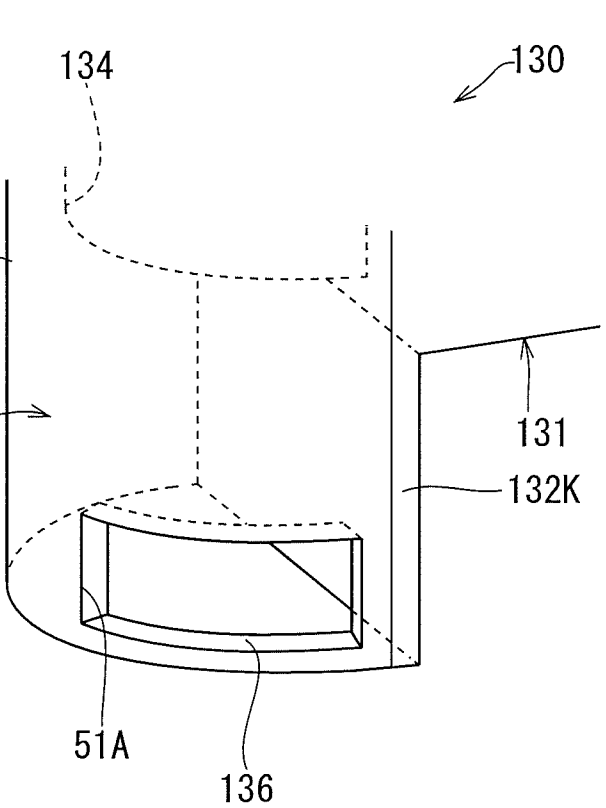
FIGS. 14A and 14B are respectively a perspective view of a casing according to a modified example and a perspective view in a periphery of an exhaust port of the casing according to the modified example.
Figure 14A:
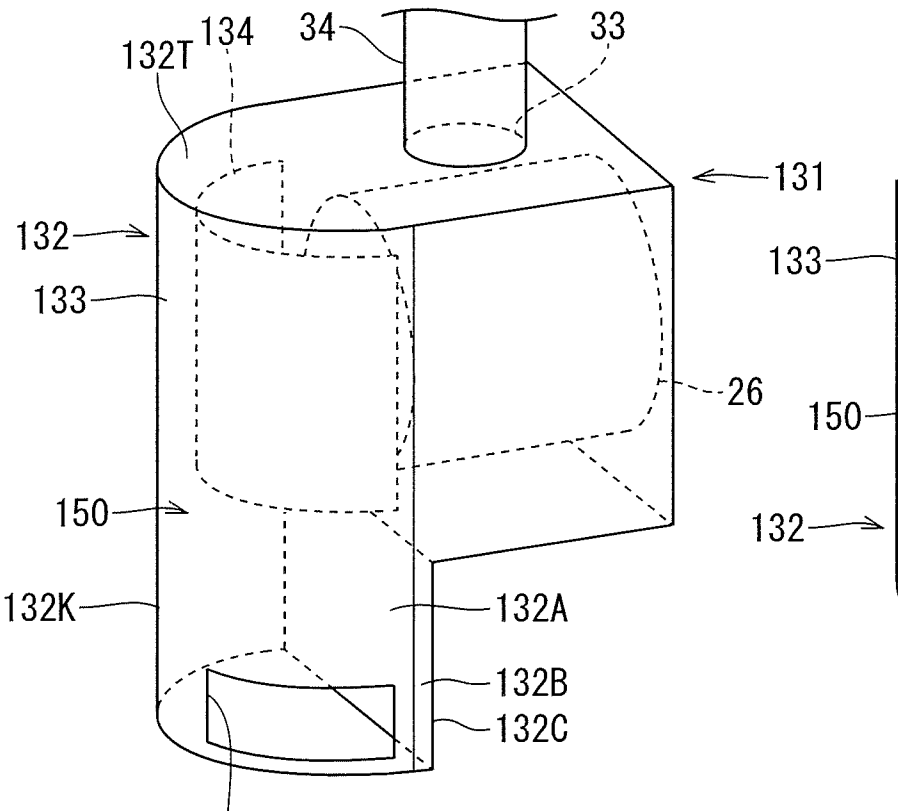

(5) In the above sixth embodiment, the casing 130 may have a configuration in which the partition plate 135 is not provided therein (see FIG. 14A). Further, in the above seventh embodiment, the partition plate 135 may be provided therein.

(6) In the above sixth and seventh embodiments, there may be provided a projecting piece 136 projecting from the opening edge of the exhaust port 51A toward the inside of each of the vertical cylinder parts 132 and 132V (see FIG. 14B. Note that FIG. 14B shows an example in which the casing 130 of the sixth embodiment includes the projecting piece 136.) This configuration makes the high temperature air H and the low temperature air L less likely to be exhausted from the exhaust port 51A, and a residence time of the high temperature air H and the low temperature air L in each of the vertical cylinder parts 132 and 132V can be longer. Note that the projecting piece 136 may project from entire opening edge of the exhaust port 51A, or may project from part of the opening edge (e.g., from the upper edge part and the side edge parts of the exhaust port 51A in FIG. 14B).

REFERENCE SIGNS LIST

10: Paint drying oven
11: Drying chamber
15: Circulation channel
25: Burner
26: Flame holding cylinder
30, 30Y, 130, 130V: Casing
31: Partition wall
32: Communication hole
33: Low temperature air inlet port
41, 41Y: Cylindrical case
50, 50V, 50W, 50X, 50Y 150, 150V: Mixing mechanism
51, 51Y:Extension cylinder
51A: Exhaust port
53: Downward guide wall
54: Upper cover plate
55: Front cover plate
57, 57V 57W, 57X: Compressing section
61: Punched plate
63: Shield plate
65: Narrowing part
131: Horizontal cylinder part
132: Vertical cylinder part
134: Heat shield plate
135: Partition plate
H: High temperature air
L: Low temperature air

The invention claimed is:

1. A paint drying oven comprising:

a drying chamber into which a painted workpiece is to be supplied;

a circulation channel connected to the drying chamber to circularly supply air heated by a burner;

a flame holding cylinder that is provided in the circulation channel and surrounds a flame of the burner;

a casing that is provided in the circulation channel, surrounds the flame holding cylinder from outside, and projects further than the flame holding cylinder toward a front end side, opposite to a burner side, of the flame holding cylinder;

a first temperature air inlet port provided on the casing to introduce first temperature air from outside into the casing;

an exhaust port provided on a front end part of the casing to exhaust second temperature air heated by the burner and the first temperature air to the circulation channel, the second temperature air having a higher temperature than the first temperature air; and a mixing mechanism that is provided in the casing and mixes the second temperature air and the first temperature air before the second temperature air and the first temperature air are exhausted from the exhaust port, the mixing mechanism including a space in a vertical cylinder part extending vertically downward with respect to a horizontal cylinder part, wherein the flame holding cylinder extends along a horizontal direction, the casing includes:

the horizontal cylinder part extending in an axial direction of the flame holding cylinder; and the vertical cylinder part extending in a vertical direction, a front end part of the horizontal cylinder part and an upper end part of the vertical cylinder part being connected to each other, the horizontal cylinder part receives the flame holding cylinder inside the horizontal cylinder part and includes the first temperature air inlet port, the vertical cylinder part includes the exhaust port at a part projecting lower than the horizontal cylinder part and causes the second temperature air and the first temperature air flowing from the horizontal cylinder part to flow downward, and the mixing mechanism is configured with the vertical cylinder part.

2. The paint drying oven according to claim 1, wherein, when viewed in an up-down direction, the vertical cylinder part is formed in a circular shape or a semi-circular shape that swells out toward a distal side from the horizontal cylinder part.

3. The paint drying oven according to claim 1, wherein the vertical cylinder part includes therein:

a heat shield plate extending along a front-end facing wall that is a part of the vertical cylinder part and faces the flame holding cylinder from the front end side, the heat shield plate covering the flame holding cylinder from the front end side; and a partition plate that projects inward, from the front-end facing wall, at a position lower than the heat shield plate and that covers from below a gap between the front-end facing wall and the heat shield plate.

4. A paint drying oven comprising:

a drying chamber into which a painted workpiece is to be supplied;

a circulation channel connected to the drying chamber to circularly supply air heated by a burner;

a flame holding cylinder that is provided in the circulation channel and surrounds a flame of the burner;

a casing that is provided in the circulation channel, surrounds the flame holding cylinder from outside, and projects further than the flame holding cylinder toward a front end side, opposite to a burner side, of the flame holding cylinder;

a first temperature air inlet port provided on the casing to introduce first temperature air from outside into the casing;

an exhaust port provided on a front end part of the casing to exhaust second temperature air heated by the burner and the first temperature air to the circulation channel, the second temperature air having a higher temperature than the first temperature air; and a mixing mechanism that is provided in the casing and mixes the second temperature air and the first temperature air before the second temperature air and the first temperature air are exhausted from the exhaust port, the mixing mechanism including a space in a vertical cylinder part extending vertically downward with respect to a horizontal cylinder part, wherein the mixing mechanism includes a downward guide wall that guides the second temperature air and the first temperature air downward;

the casing includes a partition wall provided therein to divide an inner space of the casing into two parts in the axial direction of the flame holding cylinder to partition off the inner space into a front-end-side space and a base-end-side space, the partition wall includes a communication hole formed therein to communicate between the front-end-side space and the base-end-side space, the mixing mechanism is arranged in the front-end-side space, the flame holding cylinder is arranged in the base-end-side space, the first temperature air inlet port communicates with the base-end-side space, and the downward guide wall includes:

an upper cover plate that covers an area ahead of the communication hole from above; and a front cover plate that hangs down from the upper cover plate and covers the communication hole from ahead.

5. The paint drying oven according to claim 4, wherein the casing includes:

a cylindrical case containing the flame holding cylinder and having the first temperature air inlet port; and an extension cylinder that is a different body from the cylindrical case and is attached to a front end part of the cylindrical case, and the mixing mechanism is provided in the extension cylinder.

6. A paint drying oven comprising:

a drying chamber into which a painted workpiece is to be supplied;

a circulation channel connected to the drying chamber to circularly supply air heated by a burner;

a flame holding cylinder that is provided in the circulation channel and surrounds a flame of the burner;

a casing that is provided in the circulation channel, surrounds the flame holding cylinder from outside, and projects further than the flame holding cylinder toward a front end side, opposite to a burner side, of the flame holding cylinder;

a first temperature air inlet port provided on the casing to introduce first temperature air from outside into the casing;

an exhaust port provided on a front end part of the casing to exhaust second temperature air heated by the burner and the first temperature air to the circulation channel, the second temperature air having a higher temperature than the first temperature air; and a mixing mechanism that is provided in the casing and mixes the second temperature air and the first temperature air before the second temperature air and the first temperature air are exhausted from the exhaust port, the mixing mechanism including a space in a vertical cylinder part extending vertically downward with respect to a horizontal cylinder part, wherein the mixing mechanism includes a compressing section by which a cross-sectional area of an air passage through which the second temperature air and the first temperature air pass is narrowed to narrow down flows of the second temperature air and the first temperature air, the mixing mechanism includes a downward guide wall that guides the second temperature air and the first temperature air downward, the casing includes a partition wall provided therein to divide an inner space of the casing into two parts in the axial direction of the flame holding cylinder to partition off the inner space into a front-end-side space and a base-end-side space, the partition wall includes a communication hole formed therein to communicate between the front-end-side space and the base-end-side space, the mixing mechanism is arranged in the front-end-side space, the flame holding cylinder is arranged in the base-end-side space, the first temperature air inlet port communicates with the base-end-side space, and the downward guide wall includes:

an upper cover plate that covers an area ahead of the communication hole from above; and a front cover plate that hangs down from the upper cover plate and covers the communication hole from ahead.

* * * * *